US008783454B2

(12) United States Patent
Igo

(10) Patent No.: US 8,783,454 B2
(45) Date of Patent: Jul. 22, 2014

(54) WRAPPED CONTAINER WITH ADHESIVE LABEL

(75) Inventor: Zsolt Igo, Pully (CH)

(73) Assignee: Philip Morris USA Inc., Richmond, VA (US)

( * ) Notice: Subject to any disclaimer, the term of this patent is extended or adjusted under 35 U.S.C. 154(b) by 55 days.

(21) Appl. No.: 12/975,963

(22) Filed: Dec. 22, 2010

(65) Prior Publication Data

US 2011/0147443 A1 Jun. 23, 2011

(30) Foreign Application Priority Data

Dec. 22, 2009 (EP) ..... 09252857

(51) Int. Cl.
*B65D 85/10* (2006.01)

(52) U.S. Cl.
CPC ..... *B65D 85/10* (2013.01); *B65D 85/1045* (2013.01); *B65D 85/1054* (2013.01)
USPC ..... 206/242; 206/268; 206/264; 206/269; 229/117.31; 229/117.34; 229/160.1; 229/87.13

(58) Field of Classification Search
CPC ..... B65D 85/1045; B65D 85/1054; B65D 85/10; B65D 85/1036; B65D 2575/586; B65D 2203/02; B65D 27/02; B65D 27/005
USPC ..... 206/242, 268, 269, 271, 273, 459.5, 206/831, 264, 265, 275, 276, 816; 229/87.13, 146, 160.1, 117.31, 117.34, 229/117.13, 123.1, 211, 125.01, 125.34; 40/312
See application file for complete search history.

(56) References Cited

U.S. PATENT DOCUMENTS

| | | | | | |
|---|---|---|---|---|---|
| 529,760 | A | * | 11/1894 | Stevens | 40/312 |
| 625,991 | A | * | 5/1899 | Switzer | 40/312 |
| 3,695,422 | A | * | 10/1972 | Tripodi | 206/232 |
| 5,021,274 | A | * | 6/1991 | Beck et al. | 428/40.5 |
| 5,035,935 | A | * | 7/1991 | Thomas et al. | 428/43 |
| 5,137,148 | A | * | 8/1992 | Evers | 206/271 |
| 5,533,613 | A | * | 7/1996 | Minarelli et al. | 206/268 |
| 5,558,217 | A | * | 9/1996 | Focke et al. | 206/268 |
| 5,958,536 | A | * | 9/1999 | Gelsinger et al. | 428/40.1 |
| 6,164,444 | A | * | 12/2000 | Bray et al. | 206/268 |

(Continued)

FOREIGN PATENT DOCUMENTS

| | | | |
|---|---|---|---|
| DE | 102 08 026 | A1 | 9/2003 |
| DE | 10 2006 032 556 | A1 | 1/2008 |

(Continued)

OTHER PUBLICATIONS

International Search Report dated Jun. 15, 2010 for European Patent Application No. 09252857.9-1261.

(Continued)

*Primary Examiner* — Andrew Perreault
*Assistant Examiner* — James M van Buskirk
(74) *Attorney, Agent, or Firm* — Buchanan Ingersoll & Rooney PC

(57) ABSTRACT

A wrapped container of consumer goods includes a container, at least one bundle of consumer goods housed within the container and wrapped in an inner liner, an outer wrapper wrapped around the filled container, and at least one adhesive label removably mounted on a separate carrier element. The carrier element is provided inside the outer wrapper.

11 Claims, 1 Drawing Sheet

Fig. 1

(56) References Cited

U.S. PATENT DOCUMENTS

| | | | | |
|---|---|---|---|---|
| 6,505,735 | B1 * | 1/2003 | Parker | 206/268 |
| 2010/0230303 | A1 * | 9/2010 | Buse et al. | 206/268 |
| 2012/0111746 | A1 * | 5/2012 | Tanbo et al. | 206/268 |

FOREIGN PATENT DOCUMENTS

| | | | |
|---|---|---|---|
| DE | 102007030267 | A1 * | 1/2009 |
| EP | 0 677 832 | A1 | 10/1995 |
| EP | 0 944 539 | A1 | 9/1999 |
| GB | 2250501 | A | 6/1992 |
| WO | WO 98/22367 | | 5/1998 |
| WO | WO 2004/003726 | A1 | 1/2004 |
| WO | WO 2004/074123 | A1 | 9/2004 |
| WO | WO 2004/076322 | A2 | 9/2004 |
| WO | WO 2009000427 | A1 * | 12/2008 |

OTHER PUBLICATIONS

International Search Report and Written Opinion mailed Apr. 15, 2011 for PCT/EP2010/007872.

* cited by examiner

WRAPPED CONTAINER WITH ADHESIVE LABEL

CROSS REFERENCE TO RELATED APPLICATION

This application corresponds to and claims priority under 35 U.S.C. §119 to European Application No. 09252857.9, filed Dec. 22, 2009, the entire content of which is hereby incorporated by reference.

WORKING ENVIRONMENT

Consumer goods such as, for example, elongate smoking articles, can be packaged in containers formed from folded laminar blanks. For example, elongate smoking articles, such as cigarettes and cigars, can be sold in hinge lid packs having a box for housing the smoking articles and a lid connected to the box about a hinge line extending across the back wall of the container. Such packs are constructed from one-piece laminar cardboard blanks. In use, the lid is pivoted about the hinge line to open the pack and so gain access to the smoking articles held in the box.

The smoking articles within the pack are wrapped in an inner liner. In order to access the smoking articles within the inner liner, a pre-perforated section of the inner liner is removed by the consumer upon first opening of the pack.

EP-A-0 944 539 discloses a pack for smoking articles in which a resealable barrier layer is provided in the form of an inner wrapper. The barrier layer is provided with an access aperture defined by lines of weakness in the barrier layer. A cover layer having a permanently tacky surface engageable with the barrier layer is applied to the barrier layer such that it covers the aperture and can be used to reseal the barrier layer between uses. A frame is provided between the smoking articles and the barrier layer to provide a surface against which pressure can be applied in order to close the cover layer.

It would be desirable to provide a novel container for consumer goods wherein the container provides the consumer with a choice to seal the inner packaging between uses. It would further be desirable if such a novel container could be manufactured with standard packaging machinery and with a standard barrier layer or inner liner.

SUMMARY OF SELECTED FEATURES OF THE PREFERRED EMBODIMENT

In a preferred embodiment, a wrapped container of consumer goods includes a container, at least one bundle of consumer goods housed within the container and wrapped in an inner liner, an outer wrapper, and at least one adhesive label removably mounted on a separate carrier element. The carrier element is provided inside the outer wrapper and the outer wrapper is wrapped around the container.

Preferably, the carrier element is provided between the inner liner and the container. In an alternative embodiment, the carrier element is provided between the inner liner and the consumer goods. Also preferably, the carrier element is adhered to an outer surface of the container, or to the inside of the outer wrapper.

In the preferred embodiment, the adhesive label includes a resealable adhesive. Preferably, the inner liner includes a tab portion defined by at least one line of weakness in the inner liner. Also preferably, the tab portion may be at least partially separated from the rest of the inner liner in order to provide an opening through which the consumer articles can be accessed and wherein the at least one adhesive label is capable of resealing the opening. In the preferred embodiment, the tab portion is moveable between an open position in which the consumer articles can be removed through the opening in the inner liner and a closed position. The at least one adhesive label may be attached to the tab portion during use and the at least one adhesive label is capable of retaining the tab portion in the closed position. Preferably, the adhesive label includes an adhesive free surface area, wherein this adhesive free surface area corresponds in size to the opening in the inner liner In the preferred embodiment, the wrapped container also includes an inner frame mounted within the container. The carrier element does not form any part of the inner frame. Moreover, the inner frame includes a cover layer wherein the surface structure of the cover layer is selected such that substantially no adhesive is transferred from the adhesive label to the cover layer when the adhesive label is attached to the cover layer of the inner frame.

Preferably, the at least one adhesive label includes an end portion without adhesive. Also preferably, the at least one adhesive label includes one or more rows of perforations.

In the preferred embodiment, the wrapped container includes smoking articles contained within the wrapper container.

BRIEF DESCRIPTION OF THE DRAWINGS

The invention will be further described, by way of example only, with reference to the accompanying drawings wherein like reference numerals are applied to like elements and wherein.

DETAILED DESCRIPTION

Figure 1:
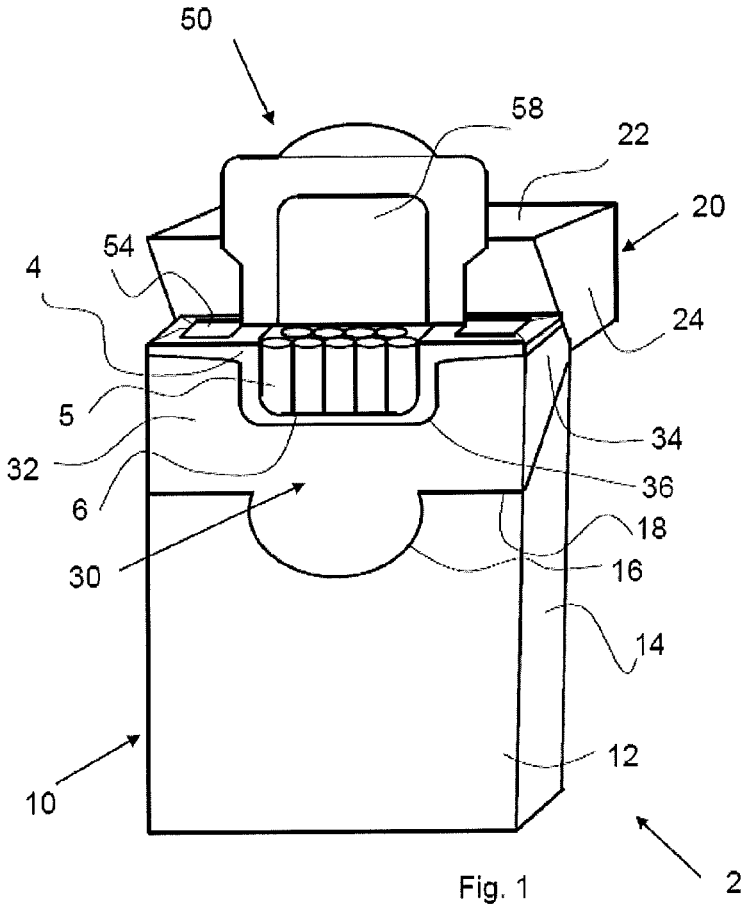
FIG. 1 shows a front perspective view of a hinge lid container according to the present invention, with an adhesive label in place on the inner liner.

The present invention relates to a wrapped container for consumer goods, wherein the wrapped container includes at least one adhesive label provided on a carrier element. The wrapped container finds particular application as a wrapped container of smoking articles.

In a preferred embodiment, a wrapped container of consumer goods includes a container, a bundle of consumer goods wrapped in an inner liner and housed within the container, an outer wrapper wrapped around the filled container, and at least one adhesive label. Preferably, the adhesive label is removably mounted on a separate carrier element. Also preferably, the carrier element with the at least one adhesive label mounted thereon is provided within the outer wrapper, that is, the carrier element is located between the outer wrapper and the container, within the container and the inner liner, or between the inner liner and the bundle of consumer goods.

As used herein, the term "separate carrier element" is used throughout the specification to denote that the carrier element is not an integral part of the container, the outer wrapper or the inner liner.

Preferably, the at least one adhesive label is removable from the carrier element and may be used for a number of different purposes. For example, the at least one adhesive label can be adapted such that it may be used to seal the inner liner between uses. This advantageously protects the consumer goods within the inner liner once the container has been opened for the first time. In another embodiment, the at least one adhesive label may be adapted such that it may be applied to the outer surface of the container for decorative purposes.

Also preferably, the at least one adhesive label may be printed or otherwise embellished and may be used, for example, to alter or emphasise the design on the exterior of the container, or to personalize the appearance of the container. Alternatively or in addition, the adhesive label may include flavor agents that may be released by the consumer. For example, the flavor may be contained in microcapsules that the consumer may rupture to release the flavor.

The dimensions of the carrier element are preferably selected so that the overall size of the wrapped container is not affected by the insertion of the carrier element. The carrier element may be inserted at the front side of the container, or at the back side of the container, or at any other side.

Preferably, the carrier element is formed from any suitable sheet material, including but not limited to paper, cardboard or plastics sheet material. The surface of the carrier element on which the at least one adhesive label is mounted is formed of a material that allows the at least one adhesive label to be securely mounted, but readily removed, for attachment to the container or inner liner. Suitable sheet materials for this purpose are known.

Also preferably, the carrier element may take the form of an "insert", which is a piece of sheet material that can be inserted into the container during manufacture. The production of inserts is well known in the art and machinery to insert sheet material into containers is well established. Thus, the wrapped container may be readily implemented using standard packaging machinery. The insert may be inserted, for example, between the inner liner and the container, or between the inner liner and the bundle of smoking articles. Thus, the insert is not visible from the outside of the pack, unless the container is at least partially transparent. The insert is therefore protected by the container itself. In addition, the insert can act as a surprise to the consumer.

Alternatively, the carrier element may take the form of an "onsert", which is inserted between the container and the outer wrapper during manufacture.

Advantageously, both insert and onsert arrangements can be achieved using existing packaging machinery and methods. For example, insert and onsert machinery are disclosed in the international patent applications WO-A-2004/003726 and WO-A-2004/076322, the entire content of each of which is incorporated herein by reference thereto.

In addition, the design of the container itself need not be altered to account for the addition of the carrier element. The at least one adhesive label can therefore readily be incorporated into wrapped containers for consumer goods without the need for any significant modification of existing apparatus, techniques and container blanks.

Providing the carrier element within the outer wrapper advantageously protects the adhesive label from abrasion and other forces that may otherwise deteriorate the functionality or visual aspect of the adhesive label. In addition, the outer wrapper prevents the inadvertent loss of the carrier element as long as the outer wrapper is intact.

In the preferred embodiment, the carrier element with the at least one adhesive label mounted thereon may be provided entirely separately from the other components. In this case, it will be simply inserted within the container or between the container and outer wrapper during assembly of the wrapped container. Alternatively, where the carrier element is provided as an onsert, the carrier element may be attached to the outer wrapper or the outside of the pack, such that it remains in place until the container is unwrapped. Preferably, in this case the carrier element is removably adhered to the inside of the outer wrapper or the outside of the container such that is can be readily detached and separated from the rest of the container once the outer wrapper has been removed. In use, the carrier element may be disposed of, once the adhesive label is removed.

In the preferred embodiment, a single adhesive label may be provided on the carrier element. Alternatively, a plurality of adhesive labels may be provided on the carrier element, which may be the same or a different size and shape to each other. If intended for the purposes of decorating the exterior of the container, the plurality of adhesive labels may be provided with the same or different graphics or text to each other. In addition, the carrier element may carry printed information underneath the adhesive label that only becomes visible once the adhesive label is removed.

In the preferred embodiment, the at least one adhesive label includes a resealable adhesive, such that the label can be removed from a surface of the container or inner liner and reattached to the same or a different surface a number of times. This is particularly advantageous where the adhesive label is intended to be used to close the inner liner, since it allows for repeated opening and closing of the inner liner in order to access the smoking articles individually. In this case, the resealable adhesive will preferably provide sufficient adhesion for the label to be reattached at least as many times as there are consumer goods in the inner liner so that it can be used to reseal the inner liner until the container is empty.

In another embodiment, the at least one adhesive label includes a first label section and a second label section. Preferably, the first label section is adapted to be attached to the inner liner such that it may cover an opening in the inner liner. Also preferably, the second label section is intended to be attached to the top of the inner liner such that it provides support for the first label section. The adhesive on the second label portion is tackier than the adhesive on the first label portion. The tackier adhesive on the second label portion attaches the label firmly to the inner liner such that the entire adhesive label is not removable when removing the first label section to gain access to the consumer goods within the inner liner.

In the preferred embodiment in which the at least one adhesive label is provided for the purposes of re-sealing the inner liner of the container, the inner liner is adapted such that an opening is provided in the inner liner in order to access the consumer goods. The opening is preferably formed when the container is opened for the first time and is then re-sealed between uses by means of the at least one adhesive label.

For example, in some embodiments, the inner liner can include a tab portion defined by at least one line of weakness in the inner liner. The tab portion may be at least partially separated from the rest of the inner liner in order to provide an opening through which the smoking articles can be accessed. The at least one adhesive label can then be used to re-seal the opening between uses.

The tab portion may be defined by lines of weakness on all sides, in which case it is completely removed in order to provide the opening. The at least one adhesive label can then be used to cover the opening left in the inner liner where the tab portion has been removed. Alternatively, the tab portion can remain attached to the inner liner after opening such that it is moveable between an open position in which the smoking articles can be removed through the opening in the inner liner and a closed position where the opening is covered again. In this case, the at least one adhesive label may be attached to the tab portion and used to retain the tab portion in the closed position between uses. This may be achieved by adhering part of an adhesive label to the tab portion and the other part to the inner liner, or another part of the container.

In the preferred embodiment, an inner frame is provided within the container, for example, between the container and the inner liner. Where an inner frame is provided and the at least one adhesive label is used to re-seal the opening of the inner liner, as described above, the at least one adhesive label may be secured to the front wall of the inner frame to retain the tab portion in a closed position to seal the container. Advantageously, an inner frame with a large surface area increases the structural strength of the container. The increased structural strength provided by the inner frame allows a secure closing of the adhesive label. This is particularly advantageous for subsequent closing operations when the container is no longer full.

Preferably, the inner frame includes a cover layer wherein the surface structure of the cover layer is selected such that substantially no adhesive is transferred from the adhesive label to the cover layer when the adhesive label is attached to the cover layer of the inner frame. For example, the inner frame may include a cover layer of laminated polyethylene terephthalate (PET). The cover layer may be transparent or metallized. Preventing the transfer of adhesive from the label to the inner frame has the advantage that dust or small particles, for example so called "tobacco shorts", will not attach to the inner frame.

In order to increase the available surface area of the inner frame to which the at least one adhesive label may be adhered, at least one of the front wall of the inner frame and the front wall of the container may be adapted such that a greater area of the inner frame is exposed upon opening the container. For example, in one embodiment a cut out is provided at the top edge of the front wall of the box of the container. The size and shape of the cut out preferably correspond to the size and shape of the at least one adhesive label so that the adhesive label may be adhered to the inner frame exposed by the cut out.

Preferably, the adhesive label includes an adhesive free surface area, wherein this adhesive free surface area corresponds in size to the opening in the inner liner. When the adhesive label is applied to the inner liner, this adhesive free surface area may cover the opening in the inner liner. This will prevent dust or small particles, for example tobacco shorts, to attach to the adhesive label where the adhesive label may come into contact with the consumer goods within the inner liner.

Preferably, the at least one adhesive label includes an end portion that does not have any adhesive on it. This may be advantageous since it facilitates the removal of the at least one adhesive label from the carrier element and also from the surface of the container, inner liner or inner frame, where present, to which it may be subsequently adhered.

Where the at least one adhesive label is intended to be applied to the exterior of the container, the at least one adhesive label may advantageously include one or more lines of weakness, such as rows of perforations, to coincide with any hinge lines on the container. This is so that the at least one adhesive label does not hinder the opening of the container in order to access the consumer goods therein.

In the preferred embodiment, the container may take any suitable form for housing consumer goods. For example, the container may be a hinge-lid container having one or more hinge lids connected to a box housing the smoking articles. Alternatively, the container may be a slide and shell container having an inner slide for housing the smoking articles mounted within an outer shell. Where the container is a slide and shell container, the outer shell or the inner slide may include one or more hinge lids.

Also in the preferred embodiment, the container, inner frame, inner liner and outer wrapper may be formed from any suitable materials including, but not limited to, cardboard, paperboard, plastic, metal, or combinations thereof. Preferably, the container is formed from one or more folded laminar cardboard blanks and preferably, the cardboard has a weight of between about 100 grams per square meter and about 350 grams per square meter.

Preferably, the inner liner is formed of metal foil or metallized paper.

Also preferably, the outer wrapper is a transparent polymeric film of, for example, high or low density polyethylene, polypropylene, oriented polypropylene, polyvinylidene chloride, cellulose film, or combinations thereof. The outer wrapper is applied in a conventional manner. The outer wrapper may include a tear tape. In addition, the over wrapper may be printed with images, consumer information or other data.

In the preferred embodiment, the container may be in the shape of a rectangular parallelepiped, with right-angled longitudinal and right-angled transverse edges. Alternatively, the container may include one or more generally rounded longitudinal edges, generally rounded transverse edges, generally bevelled longitudinal edges or generally bevelled transverse edges, or combinations thereof. For example, the container may include, without limitation:

- One or two longitudinal generally rounded or generally bevelled edges on the front wall, and/or one or two longitudinal generally rounded or generally bevelled edges on the back wall.
- One or two transverse generally rounded or generally bevelled edges on the front wall, and/or one or two transverse generally rounded or generally bevelled edges on the back wall.
- One longitudinal generally rounded edge and one longitudinal generally bevelled edge on the front wall, and/or one transverse generally rounded edge and one transverse generally bevelled edge on the back wall.
- One or two transverse generally rounded or generally bevelled edges on the front wall and one or two longitudinal generally rounded or generally bevelled edges on the front wall.
- Two longitudinal generally rounded or generally bevelled edges on a first side wall or two transverse generally rounded or generally bevelled edges on the second side wall.

Where the container includes one or more generally rounded edges and is made from one or more laminar blanks, preferably the blanks include three, four, five, six or seven scoring lines or creasing lines to form each rounded edge in the assembled container. The scoring lines or creasing lines may be either on the inside of the container or on the outside of the container. Preferably, the scoring lines or creasing lines are spaced from each other by a distance ranging from about 0.3 mm to about 4 mm.

Preferably, the spacing of the creasing lines or scoring lines is a function of the thickness of the laminar blank. Preferably, the spacing between the creasing lines or scoring lines ranges from about 0.5 to about 4 times larger than the thickness of the laminar blank.

Where the container includes one or more generally bevelled edges, preferably the generally bevelled edge has a width ranging from about 1 mm to about 10 mm, preferably ranging from about 2 to about 6 mm. Alternatively, the container may include a double bevel formed by three parallel creasing or scoring lines that are spaced such that two distinct bevels are formed on the edge of the container.

Where the container includes a generally bevelled edge and is made from one or more laminar blanks, the bevel may be formed by two parallel creasing lines or scoring lines in the laminar blank. The creasing lines or scoring lines may be arranged symmetrically to the edge between a first wall and a second wall. Alternatively, the creasing lines or scoring lines may be arranged asymmetrically to the edge between the first wall and the second wall, such that the bevel reaches further into the first wall of the container than into the second wall of the container.

Alternatively, the container may have a non-rectangular transversal cross section, for example generally polygonal such as triangular or hexagonal, or generally oval, generally semi-oval, generally circular or generally semi-circular.

In the preferred embodiment, the container may find particular application as a pack for elongate smoking articles such as, for example, cigarettes, cigars or cigarillos. It will be appreciated that through appropriate choices of the dimensions thereof, the container may be designed for different numbers of conventional size, king size, super-king size, slender or super-slender cigarettes.

Through an appropriate choice of the dimensions thereof, the container may be designed to hold different total numbers of smoking articles, or different arrangements of smoking articles. For example, through an appropriate choice of the dimensions thereof, the container may be designed to hold a total of about ten to about thirty smoking articles.

Preferably, the smoking articles in the container may be arranged in different collations, depending on the total number of smoking articles. For example, the smoking articles may be arranged in a single row of six, seven, eight, nine or ten. Alternatively, the smoking articles may be arranged in two or more rows. The two or more rows may contain the same number of smoking articles. For example, the smoking articles may be arranged in: two rows of five, six, seven, eight, nine or ten; three rows of five or seven; or four rows of four, five or six. Alternatively, the two or more rows may include at least two rows containing different number of smoking articles to each other. For example, the smoking articles may be arranged in: a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7).

Also preferably, the container may hold smoking articles of the same type or brand, or of different types or brands. In addition, both filterless smoking articles and smoking articles with various filter tips may be contained, as well as smoking articles of differing length (for example, about 40 mm to about 180 mm), diameter (for example, about 4 mm to about 9 mm). In addition, the smoking articles may differ in strength of taste, resistance to draw and total particulate matter delivery. Preferably, the dimensions of the container are adapted to the length of the smoking articles, and the collation of the smoking articles. The outer dimensions of the container range from about 0.5 mm to about 5 mm larger than the dimensions of the bundle or bundles of smoking articles housed inside the container.

The length, width and depth of container may be such that, in the closed position, the resultant overall dimensions of the container are similar to the dimensions of a typical disposable hinge-lid pack of twenty cigarettes.

Preferably, the container has a height ranging from about 60 mm to about 150 mm, more preferably a height ranging from about 70 mm to about 125 mm, wherein the height is measured from the top wall to the bottom wall of the container.

Preferably, the container has a width ranging from about 12 mm to about 150 mm, more preferably a width ranging from about 70 mm to about 125 mm, wherein the width is measured from one side wall to the other side wall of the container.

Preferably, the container has a depth ranging from about 6 mm to about 100 mm, more preferably a depth ranging from about 12 mm to about 25 mm wherein the depth is measured from the front wall to the back wall of the container (including the hinge between box and lid).

Preferably, the ratio of the height of the container to the depth of the container ranges from about 0.3 to 1 to about 10 to 1, more preferably about 2 to 1 to about 8 to 1, and most preferably about 3 to 1 to 5 to 1.

Preferably, the ratio of the width of the container to the depth of the container ranges from about 0.3 to 1 to about 10 to 1, more preferably about 2 to 1 to about 8 to 1, and most preferably about 2 to 1 to 3 to 1.

As well as housing a bundle of smoking articles, the container may further include other consumer goods, for example matches, lighters, extinguishing means, breath-fresheners or electronics. The other consumer goods may be attached to the outside of the container, contained within the container along with the smoking articles, in a separate compartment of the container or combinations thereof.

The exterior surface of the container may be printed, embossed, debossed or otherwise embellished with manufacturer or brand logos, trade marks, slogans and other consumer information and indicia.

As shown in FIG. 1, the hinge lid container 2 is a generally rectangular parallelepiped and includes a box 10 and a lid 20 that is hinged to the box 10 along a hinge line extending substantially horizontally along the back wall of the container 2. A bundle of cigarettes 5 is housed in the box 10 of the container 2. The bundle 5 is wrapped in an inner liner 4. The overall size and construction of the box 10 and lid 20 of container 2 are substantially the same as that of a standard hinge lid cigarette pack.

Preferably, the box 10 has a box front wall 12, a box left side wall, a box right side wall 14, a box back wall, and a box bottom wall.

As used herein, the terms "front", "back", "upper", "lower", "side", "top", "bottom" and other terms used to describe relative positions of the components of the container 2 refer to the container in an upright position with the lid 20 at the top end and the hinge on the back. The terms "left" and "right" are used with reference to side walls of the container when the container 2 is viewed from the front in its upright position. When the container in the upright position is open, the cigarettes 5 contained in the box 10 may be removed from the upper end of the container 2.

Preferably, the upper side of the box 10 is open, to provide an upper opening through which the cigarettes 5 can be removed. The box front wall 12 may include a generally semi-circular cut out 16 at the upper free edge 18, the purpose of which will be described below.

Also preferably, the lid 20 has a lid front wall 22, a lid left side wall, a lid right side wall 24, a lid back wall and a lid top wall. When the container 2 is closed, the free edges of the walls of the lid 20 abut the free edges of the walls of the box 10 along a line of abutment, except at the front of the container where the cut out 16 is provided. In the closed position, the walls of the lid 20 therefore form extensions of the corresponding walls of the box 10 to define the walls of the container 2.

In the preferred embodiment, an inner frame 30 is mounted within the box 10 of the container 2. The inner frame 30 includes an inner frame front wall 32, an inner frame left side wall and an inner frame right side wall 34 which are connected to the inner surface of the box front wall 12, box left side wall and box right side wall 14, respectively. The inner frame front wall 32 includes a generally rectangular cut out 36 at the top free edge thereof, in order to facilitate removal of the cigarettes 5 from the box 10. The inner frame front wall 32 is of sufficient length that it extends below the cut out 16 provided in the box front wall 12.

Prior to first opening, the container 2 is wrapped in an outer wrapper (not shown) formed of a transparent film, in the conventional manner.

Figure 2:
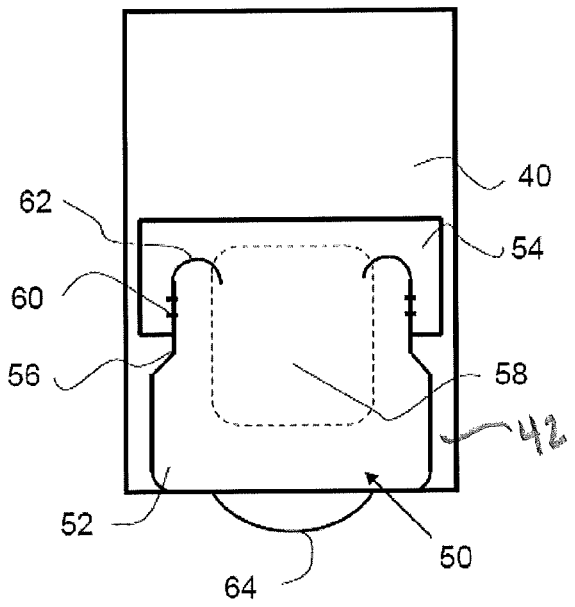
FIG. 2 shows the carrier element including the adhesive label on a carrier layer.

Preferably, the wrapped container includes the carrier element, or insert 40, shown in FIG. 2, which is inserted between the box 10 and the inner liner 4 during assembly of the container 2. The insert 40 is generally rectangular in shape and slightly smaller in size than the front wall of the container, such that it may be conveniently inserted within the container.

Preferably, the insert 40 includes a carrier layer 42 on which is provided a sticker, or self-adhesive label 50. The label 50 includes a substantially rectangular first label portion 52 that is intended to be attached to the upper front side of the inner liner 4. The label 50 further includes a substantially rectangular second label portion 54 that is connected to the first label portion 52. The second label portion 54 is intended to be attached to the top side of the inner liner 4 as shown in FIG. 1. The edge 56 of the first label portion 52 extends as a cut into the second label portion 54 in order to allow a section of the second label portion 54 to be lifted off the top of the inner liner 4 to allow access to cigarettes 5. These cuts terminate in generally semicircular cuts 62. The semicircular shape prevents the cuts from being further torn when the label 50 is detached from the inner liner 4.

Preferably, the cuts are bridged with small material bridges 60. The material bridges 60 are designed such that the force needed to remove the label 50 from the carrier layer 42 is not sufficient to break the bridges, maintaining the integrity of the label 50. This simplifies the application of the label 50 onto the inner liner 4. The material bridges 60 will easily break once the label 50 is attached to the inner liner 4 and the label is lifted to get access to the cigarettes 5.

Also preferably, the side of the label 50 that is facing the carrier 40 is covered with a peelable, resealable adhesive except in the surface area 58 shown with dashed lines in FIG. 2. The surface area 58 covers the opening in the inner liner 4 when applied to the inner liner 4. Due to the lack of adhesive in this surface area 58, dust and small particles like, for example, tobacco shorts, or the end of the cigarettes 5 will not adhere to the label 50. In addition, transfer of adhesive from the label 50 to the cigarettes 5 is prevented.

In the preferred embodiment, a generally semi-circular or arcuate tab portion 64 extends from the bottom edge of the first label portion 52. Preferably, the diameter of the semi-circular portion 64 is less than the width of the lower part of the first label portion 52 such that is does not extend the full width of the label 50. The semi-circular portion 64 of the label 50 does not include adhesive, thereby facilitating removal of the sticker from the label 50 and subsequently, from the container.

In order to securely close the opening of the inner liner, thereby resealing the inner liner 4, the lower part of the first label portion 52 of the label 50 may be adhered to the inner liner 4 at the front of the wrapped bundle and the inner frame front wall 32. When the inner liner is sealed or closed, the semi-circular portion 64 of the sticker will lie within the cut out 16 provided in the front wall of the box 10 of the container 2. The size and shape of the label 50 is such that it fully covers the opening in the inner liner, thereby providing a good seal.

Preferably, the adhesive on the label 50 is such that the label 50 may be removed from the inner frame 30 and resealed in order to open and close the opening in the inner liner 4 a plurality of times, until the container 2 is empty. To prevent adhesive being transferred from the label 50 to the inner frame 30, the inner frame 30 is covered with a metallized layer of laminated polyethylene terephthalate (PET).

In the preferred embodiment, the container 2 may be filled and assembled using conventional apparatus and methods, modified to include a conventional machine for adding the insert 40 with the label 50 to the container.

In this specification, the word "about" is often used in connection with numerical values to indicate that mathematical precision of such values is not intended. Accordingly, it is intended that where "about" is used with a numerical value, a tolerance of ±10% is contemplated for that numerical value.

In this specification the words "generally" and "substantially" are sometimes used with respect to terms. When used with geometric terms, the words "generally" and "substantially" are intended to encompass not only features which meet the strict definitions but also features which fairly approximate the strict definitions.

While the foregoing describes in detail a preferred wrapped container with adhesive label and method with reference to a specific embodiment thereof, it will be apparent to one skilled in the art that various changes and modifications may be made to the wrapped container and equivalents method may be employed, which do not materially depart from the spirit and scope of the invention. Accordingly, all such changes, modifications, and equivalents that fall within the spirit and scope of the invention as defined by the appended claims are intended to be encompassed thereby.

I claim:

1. A wrapped container of consumer goods comprising:

a container;

at least one bundle of consumer goods housed within the container and wrapped in an inner liner;

an outer wrapper; and an adhesive label removably mounted on a separate carrier element, wherein the carrier element is provided inside the outer wrapper, is not adhesively attached to the inner liner, and the outer wrapper is wrapped around the container, and wherein the inner liner includes an access opening, the adhesive label is configured to completely cover that access opening when the label is removed from the carrier element and adhered to the inner liner, and the label includes an openable portion along three edges sized to cover the access opening for access to the consumer goods in the inner liner, the openable portion being resealable around the access opening, and the openable portion being defined by a cutline in the label having a tear inhibiting portion.

2. The wrapped container of claim 1, wherein the carrier element is a loose piece provided between the inner liner and the container.

3. The wrapped container of claim 1, wherein the carrier element is a loose piece provided between the inner liner and the consumer goods.

4. The wrapped container of claim 1, wherein the label includes a tab portion defined by at least one line of weakness in the label to define the openable portion.

5. The wrapped container of claim 1, wherein the tab portion is moveable between an open position in which the consumer articles can be removed through the opening in the inner liner and a closed position.

6. The wrapped container of claim 1, wherein the adhesive label includes an adhesive free surface area, wherein this adhesive free surface area corresponds in size to the opening in the inner liner.

7. The wrapped container of claim 1, further including an inner frame mounted within the container, wherein the carrier element does not form any part of the inner frame.

8. The wrapped container of claim 7, wherein the inner frame includes a cover layer wherein the surface structure of the cover layer is selected such that substantially no adhesive is transferred from the adhesive label to the cover layer when the adhesive label is attached to the cover layer of the inner frame.

9. The wrapped container of claim 1, wherein the adhesive label includes an end portion without adhesive.

10. The wrapped container of claim 1, wherein the adhesive label includes one or more rows of perforations.

11. The wrapped container of claim 1, further including smoking articles contained within the wrapper container.

* * * * *